US006299274B1

(12) United States Patent
Bolash et al.

(10) Patent No.: US 6,299,274 B1
(45) Date of Patent: Oct. 9, 2001

(54) THERMAL INK JET PRINTER CARTRIDGE IDENTIFICATION

(75) Inventors: John Philip Bolash; Mark Joseph Edwards; Edmund Hulin James, III, all of Lexington; George Keith Parish, Winchester, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 08/990,608

(22) Filed: Dec. 15, 1997

(51) Int. Cl.[7] ..... B41J 29/393
(52) U.S. Cl. ..... 347/19
(58) Field of Search ..... 347/19, 85–87; 400/692, 175; 399/12, 13, 2, 27, 25, 24, 90, 111, 113, 146

(56) References Cited

U.S. PATENT DOCUMENTS

| | | | | |
|---|---|---|---|---|
| 4,411,540 | | 10/1983 | Nozaki et al. | 400/175 |
| 4,428,694 | | 1/1984 | Ragen | 400/144.2 |
| 4,741,634 | | 5/1988 | Nozaki et al. | 400/120 |
| 4,846,593 | | 7/1989 | Ueda et al. | 400/157.3 |
| 4,872,027 | | 10/1989 | Buskirk et al. | 347/19 |
| 4,872,773 | | 10/1989 | Ueda | 400/144.2 |
| 4,930,915 | | 6/1990 | Kikuchi et al. | 400/175 |
| 5,005,995 | | 4/1991 | Bruns et al. | 400/144.2 |
| 5,033,887 | * | 7/1991 | Bauerle | 400/175 |
| 5,049,898 | | 9/1991 | Arthur et al. | 347/19 |
| 5,049,904 | | 9/1991 | Nakamura et al. | 347/19 |
| 5,167,460 | | 12/1992 | Kikukawa | 400/175 |
| 5,235,351 | | 8/1993 | Koizumi | 347/19 |
| 5,289,210 | | 2/1994 | Takayanagi | 347/19 |
| 5,471,163 | | 11/1995 | Childers | 347/50 |
| 5,488,223 | | 1/1996 | Austin et al. | 347/19 |
| 5,506,611 | * | 4/1996 | Ujita et al. | 347/19 |
| 5,710,418 | * | 1/1998 | Tawara | 235/472 |
| 5,835,817 | * | 11/1998 | Bullock et al. | 347/19 |

FOREIGN PATENT DOCUMENTS

| | | | |
|---|---|---|---|
| 0 720 916 A2 | | 1/1996 | (EP) . |
| 0 720 916 A3 | | 1/1996 | (EP) . |
| 0 812 693 A1 | | 12/1997 | (EP) . |
| 05345411 | * | 6/1992 | (JP) . |
| WO 97 23352 | | 7/1997 | (WO) . |

* cited by examiner

*Primary Examiner*—John Barlow
*Assistant Examiner*—Juanita Stephens
(74) *Attorney, Agent, or Firm*—David E. LaRose, Esq.; John V. Pezdek

(57) ABSTRACT

The invention described in the specification relates to an apparatus for supplying electrical information to a printer controller in order to identify the one or more cartridges installed in a printer. The apparatus comprises a carriage which is laterally translatable relative to the movement of print media through the printer, carriage translation means, and a replaceable cartridge attached to the carriage. The apparatus further comprises an indicia device which is attached to the replaceable cartridge and which has optically readable indicia thereon containing encoded information which contains information identifying the type of cartridge installed in the printer. The apparatus also includes an optical code reader which reads and transmits the encoded information to a printer controller as the cartridge moves in a lateral direction relative to the code reader. The invention thus uses the linear motion of the carriage in combination with the optically readable indicia device on the cartridge to identify the type of cartridge, or to otherwise control the printer depending on the specific information provided by the indicia device.

11 Claims, 3 Drawing Sheets

THERMAL INK JET PRINTER CARTRIDGE IDENTIFICATION

FIELD OF THE INVENTION

The present invention is generally directed to ink jet printers, and is more particularly directed to an apparatus for encoding and translating encoded cartridge identification information for use by a printer controller.

BACKGROUND OF THE INVENTION

Thermal ink jet printers apply ink to a print medium by ejecting small droplets of ink from an array of nozzles located in the printhead of a print cartridge. An array of thin-film resistors on an integrated circuit on the printhead selectively generates heat as current is passed through the resistors. The heat causes ink contained within an ink reservoir adjacent to the resistors to boil and be ejected from the array of nozzles associated with the resistor array. A printer controller determines which resistors will be "fired" and the proper firing sequence so that the desired pattern of dots is printed on the medium to form an image.

Conventional ink jet printers accommodate replaceable print cartridges containing either multiple colors of ink or a single color of ink. When the print cartridge is changed, information identifying the type of cartridge installed must be given to the printer so that the printer will function properly with the cartridge. User intervention is conventionally used to identify to the printer controller the type of cartridge installed.

In order to reduce the cost and complexity of print cartridge manufacturing processes, it is desirable for all cartridges used with a printer to be constructed with a similar configuration regardless of the type of cartridge or color of ink the cartridge contains. Thus it is desirable to maintain substantial overall uniformity of the cartridge shapes and sizes so that a single cartridge design can be used for multiple purposes. However, maintaining a uniform cartridge design makes it more difficult to easily identify the contents of the cartridge or the particular cartridge being used.

An object of the invention is to provide a relatively simple and inexpensive apparatus for encoding information on a replaceable print cartridge.

Another object of the invention is to provide cartridge-specific information, such as ink color and type of cartridge, directly on the cartridge in a manner that is detectable by the printer controller so that the controller may be automatically adjusted without the need for user intervention.

A further object of the invention is to provide a cartridge encoding system which can be configured for a wide variety of cartridge types.

SUMMARY OF THE INVENTION

With regard to the above and other objects, the invention provides an apparatus for supplying electrical information to a printer controller of a printer based on the identity of a replaceable accessory cartridge installed in the printer. The apparatus comprises a carriage which is laterally translatable relative to the movement of print media through the printer, a carriage translation means, a replaceable accessory cartridge removably attached to the carriage, the accessory cartridge selected from the group consisting of ink cartridges and scanner cartridges, at least one indicia device on the cartridge, the indicia device containing encoded information which identifies to the controller the accessory cartridge installed in the printer, the indicia device comprising optically-reflective images and optically-nonreflective images for reflecting or adsorbing of a first light signal, the reflected portions of the first light signal constituting a second light signal and a light signal reading device for reading the information encoded on the indicia device as the cartridge moves in a lateral direction relative to the reading device, the reading device producing an electrical output signal to the printer controller in response to reflected and/or absorbed light signals wherein the reading device comprises a light-emitting diode for emitting the first light signal toward the indicia device to illuminate the indicia device, at least one lens for focusing the first light signal onto the indicia device as the indicia device translates laterally in relation to the light signal reading device and a detector for receiving the second light signal reflected from the indicia device, and for producing the electrical output signal to the printer controller.

In another aspect, the invention provides a printer which includes an apparatus for controlling printer operation based on the identity of replaceable ink cartridges in a carriage for the ink. The apparatus comprises a carriage which is laterally translatable relative to the movement of print media through the printer and which contains two, three or four cartridge locations, a carriage translation means, two, three or four replaceable ink cartridges containing ink reservoirs and printheads removably attached to the carriage, at least one indicia device on the cartridge, the indicia device containing encoded information which identifies to the controller which ink reservoir is installed in which cartridge location of the carriage, the indicia device comprising optically-reflective images and optically-nonreflective images for reflecting or adsorbing of a first light signal, the reflected portions of the first light signal constituting a second light signal and a light signal reading device for reading the information encoded on the indicia device as the cartridges move in a lateral direction relative to the reading device, the reading device producing an electrical output signal to the printer controller in response to reflected and/or absorbed light signals wherein the reading device comprises a light-emitting diode for emitting the first light signal toward the indicia device to illuminate the indicia device, at least one lens for focusing the first light signal onto the indicia device as the indicia device translates laterally in relation to the light signal reading device and a detector for receiving the second light signal reflected from the indicia device, and for producing the electrical output signal to the printer controller.

The invention thus uses the linear motion of the carriage in combination with an optically readable indicia device on the cartridge to identify the type of cartridge, or to otherwise control various printer functions depending on the specifically encoded information and the location of the cartridge in the carriage. As the carriage containing the cartridge moves relative to substantially fixed code reader, information is extracted from the indicia device and translated into an electrical signal. For example, an ink jet print cartridge moves laterally relative to the movement of the print medium as the printhead ejects ink onto the medium to form printed characters. As the cartridge moves across the print medium, there is movement of the encoded indicia relative to the position of the code reader which remains relatively stationary during the printing operation.

For the purpose of simplifying the description, the invention is described in terms of a print cartridge which is attached to a carriage of a printer. However, the indicia device may be attached to a movable cartridge used to scan printed pages in order to translate a scanned image into a digital image, or to "read" or translate magnetic data or indicia on a medium into a digital input for a computer. Other types of cartridges or combinations of cartridges may be used with the carriage, indicia device, and code reader according to the invention.

An advantage of the indicia device and code reader according to the invention is that cartridge identification information may be easily applied to the cartridge at any point in the manufacturing process. Furthermore, the indicia device applied to the cartridge may be encoded for a wide variety of cartridge types, may be used to control various printer functions, and does not require physical connection between the encoded indicia and the code reader.

BRIEF DESCRIPTION OF THE DRAWINGS

Other aspects and advantages of the invention are provided by the following detailed description of preferred embodiments considered in conjunction with the following drawings, in which like reference numerals denote like elements throughout the several views, and wherein.

DETAILED DESCRIPTION OF THE INVENTION

Figure 1:
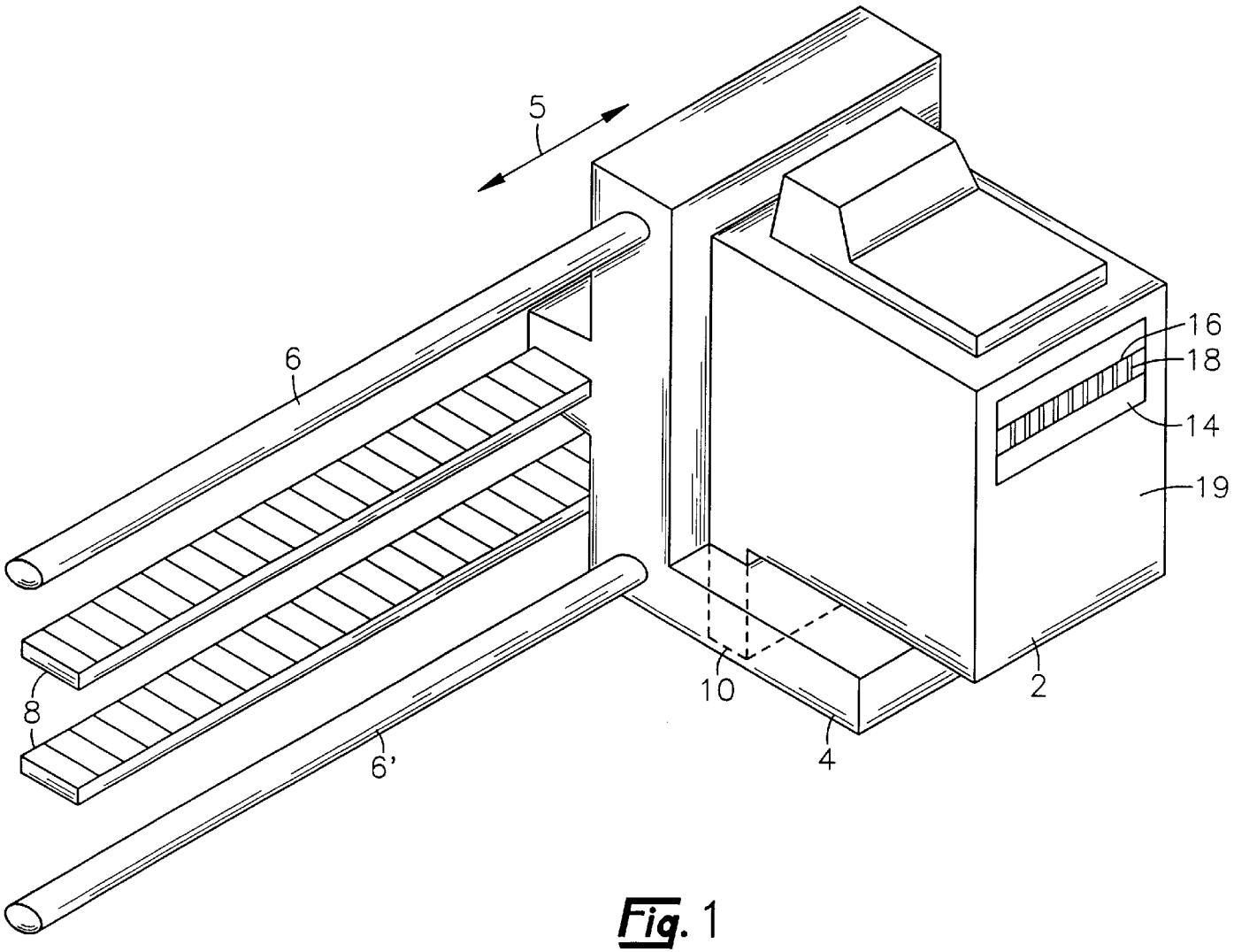
FIG. 1 is a perspective view, not to scale, of a carriage and cartridge containing optical indicia according to the invention.
Figure 2:
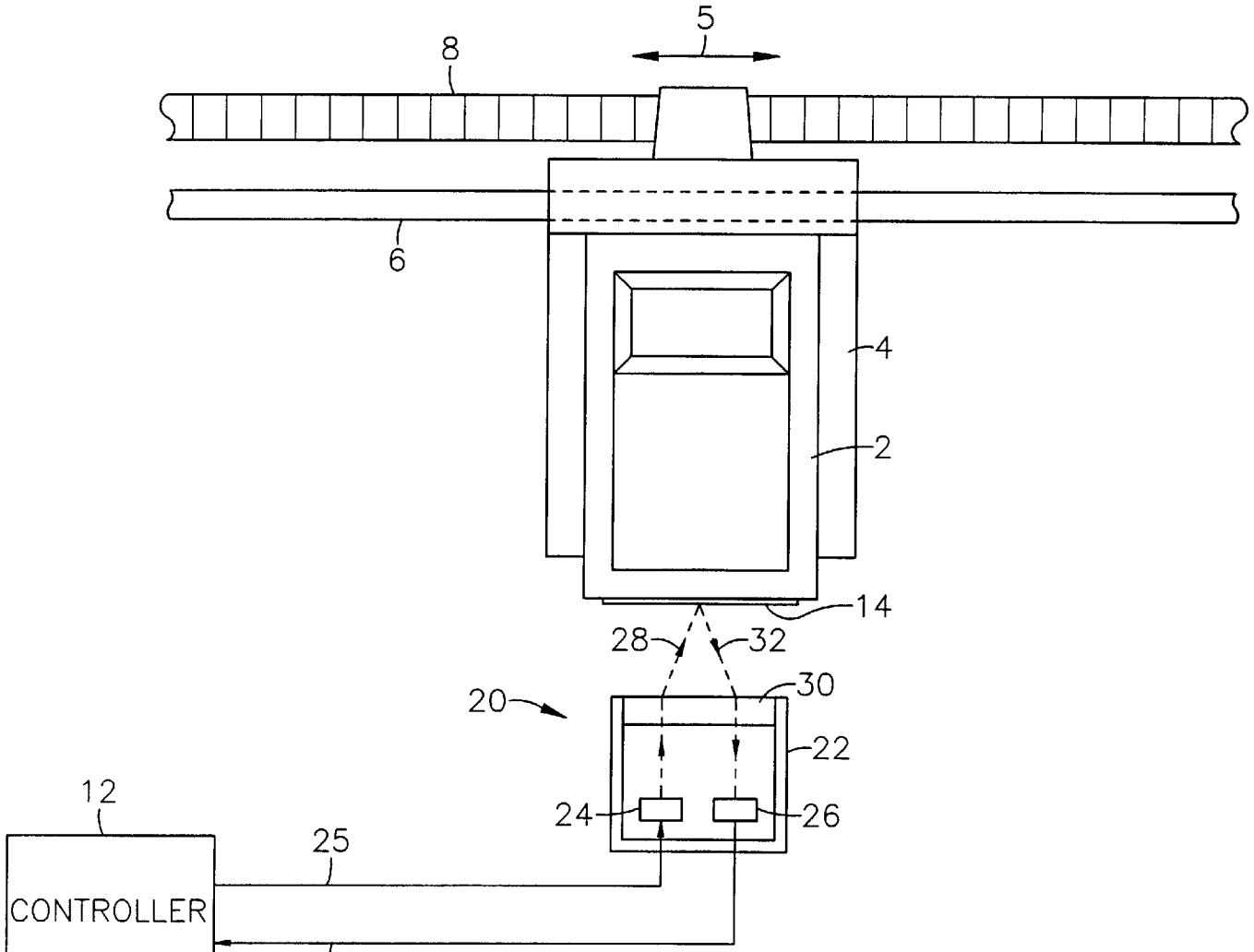
FIG. 2 is a top plan view, not to scale, of a portion of a printer showing a print cartridge, carriage, and optical code reader according to the invention.

With reference to FIGS. 1 and 2, a replaceable cartridge 2 containing ink is attached to a movable carriage 4 so that, when the printer is in operation, the carriage moves the cartridge in a lateral direction indicated by the arrow 5. The carriage 4 is supported and guided by a pair of rails 6 and 6' on which the carriage 4 is free to slide. A belt 8 is fixedly attached to the carriage 4 and provides a motive force which causes the carriage 4 to move linearly along the rails 6 and 6'. The rails 6 and 6' and belt 8 constitute a preferred embodiment of carriage translation means for moving the carriage 4 in the direction indicated by the arrow 5. During a printing procedure, the carriage 4 is moved laterally across a print medium, such as paper, as ink is ejected from the cartridge 2 through a printhead 10 onto the print medium.

The printhead 10, which is shown as an integral part of the cartridge 2, contains a plurality of ink ejection nozzles and an ink ejection device for forcing ink from the printhead 10 onto the print medium. The printhead 10 generally extends below the carriage 4 when the cartridge 2 is mounted in the carriage 4. A printer controller 12, electrically connected to the cartridge 2 by a flexible cable and a connection device, controls the ejection of the ink from individual nozzles on the printhead 10 so that the ink impacts on the print medium in a specific sequence to produce an image as the printer cartridge 4 moves across the print medium in the direction indicated by the arrow 5. The printer controller 12 also causes the print medium to move through the printer as the printhead 10 moves orthogonally to the direction of movement of the print medium.

With continued reference to FIG. 1, a label 14 containing indicia is affixed to a surface of the cartridge 2. Preferably, the label 14 is formed from a material such as paper or plastic, and has an adhesive material on one surface for fixedly attaching the label to the cartridge 2. The opposing surface of the label 14 contains optically readable indicia 16 which comprises optically-reflective and optically-nonreflective images which provide encoded information identifying the type of cartridge 2 to which the label 14 is affixed. The indicia 16 is preferably in the form of bar code characters 18 which are printed across the surface of the label 14.

In an alternative embodiment, the optically readable indicia 16 is printed directly on the cartridge 2 rather than on a label 14. The indicia 16 may be applied to the cartridge 2 by a process such as screen printing. In such case, the color of the cartridge body 2 in the area of the label must be sufficient to provide an optically identifiable contrast between the indicia 16 and the surface 19 of the cartridge 2.

FIG. 2 is a top plan view of the printer showing the relative positions of the cartridge 2, carriage 4, rails 6, and belt 8. Also illustrated in FIG. 2 is an optical code reader 20 which remains relatively stationary during the printing operation. A preferred optical code reader 20 is a reflective sensor available from Hewlett Packard Company of Palo Alto, Calif. under the product code HBCS-1100. A typical optical code reader 20 includes a housing 22 containing an emitter 24 and a detector 26 therein which cooperate to produce an electrical signal responsive to the optically-readable indicia 16 on the label 14. The optical code reader 20 is positioned such that the label 14 on the cartridge 2 passes proximate to without contacting the optical code reader 20 as the carriage 4 moves linearly along the rails 6.

In a preferred embodiment, the emitter 24 of the optical code reader 20 is a light emitting diode which emits a first light signal 28 at a wavelength of about 700 nanometers responsive to an electrical input signal from the controller 12 on the electrical conduit 25. The first light signal 28 passes through a lens 30 which is also contained within or attached to the housing 22. The lens 30 is preferably a bifurcated aspheric lens which focuses the first light signal 28 to produce a spot which is about 0.190 millimeters in diameter and which is focused at a point which is about 4.3 millimeters forward of the lens 30.

As described above, characters 18 on the label 14 are comprised of optically reflective and non-reflective images. As the cartridge 2 moves past the optical code reader 20, the characters 18 move through the focal point of the first light signal 28 and either reflect or absorb the first light signal 28. The non-reflective portions of the label 14 reflect a relatively insignificant amount of the first light signal 28, whereas the reflective portions of the label 14 reflect a significant portion of the first light signal 28 back toward the optical code reader 20. The reflected portions of the first light signal 28 constitute a second light signal 32. When the indicia 16 is in the form of a bar code, the second light signal 32, produced as the cartridge 2 and label 14 move past the code reader 20, is provided as a series of light pulses caused by reflection and absorption of portions of the first light signal 28.

With continued reference to FIG. 2, the second light signal 32 also passes through the lens 30 and is intercepted by the detector 26. The detector 26 is preferably a photodiode matched to receive a light signal from the emitter 24. The detector 26 converts the second light signal 32 into an electrical output signal. The electrical signal, which contains the printer cartridge identification information, is conducted to the printer controller 12 through an electrical conduit 34.

When the printer is in operation, cartridge identification information is transmitted to the printer controller 12 responsive to the characters 18 on the label 14. When the printer power is first turned on, or when the cartridge 2 is removed or replaced, the printer controller 12 causes the carriage 4 to move the cartridge 2 past the code reader 20. As the cartridge 2 moves relative to the code reader 20, the code reader 20 reads the characters 18 on the label 14 and transmits an electrical output signal responsive to the characters to the printer controller 12. The printer controller 12 adjusts or controls the printer for proper operation with the installed cartridge 2 in response to the encoded information on the cartridge 2. The printer adjustments can thus be made automatically without user input.

Since the scope of the invention is not limited to the identification of print cartridges only, it will be appreciated that the invention is also applicable to the identification of any type of interchangeable or replaceable accessory cartridge which may be installed in a printer. For example, the invention also provides for the identification of a cartridge containing an image-scanning or image-reading device which may be installed in place of, or in addition to, a print cartridge. Furthermore, the invention provides for the identification of an ink cartridge which may be provided as a replaceable cartridge which is separate from the printhead.

Figure 3:
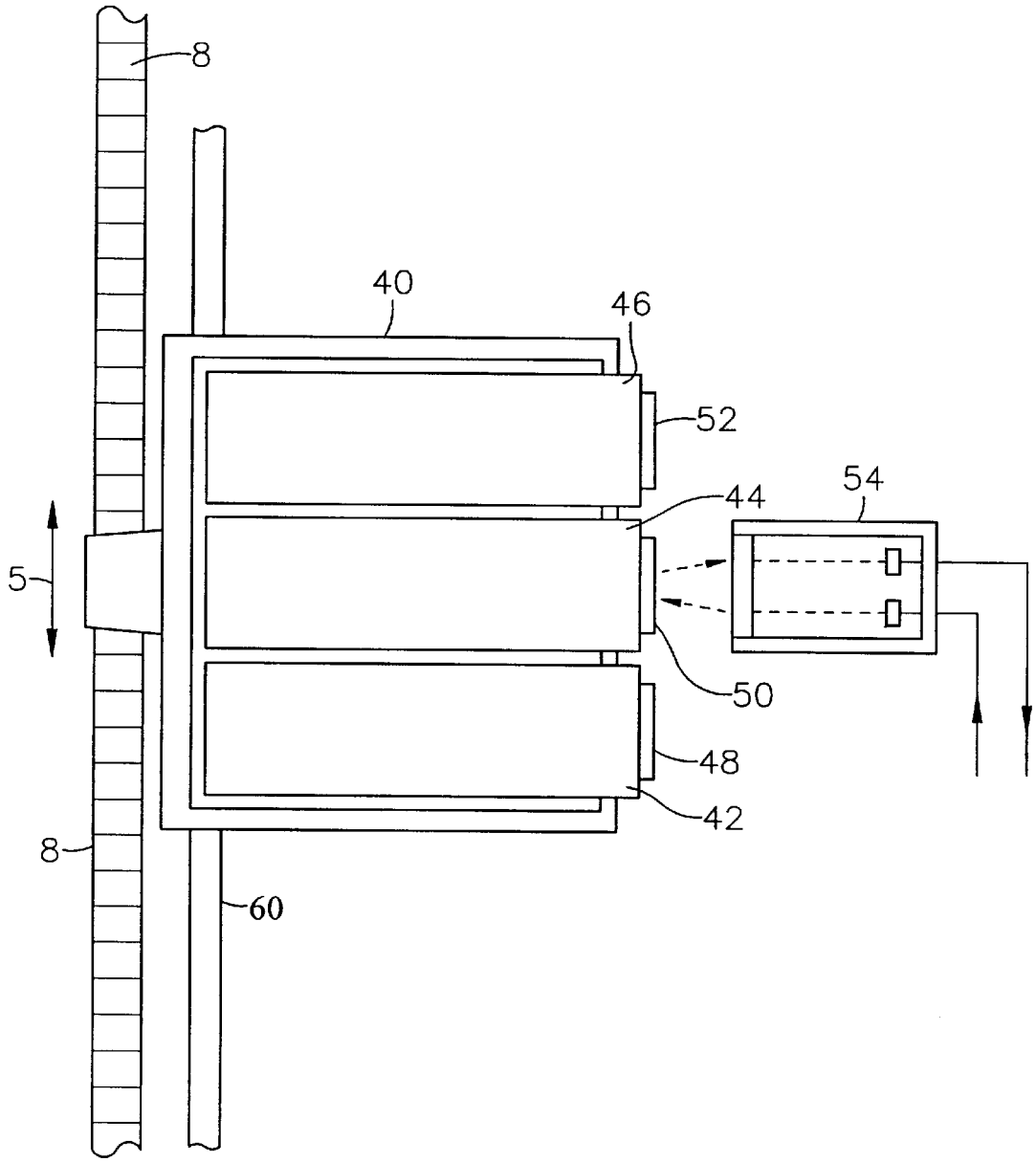
FIG. 3 is a top plan view, not to scale, of a portion of a printer showing a carriage containing multiple cartridges, and optical code reader according to the invention.

It will also be appreciated that the invention is not limited to the identification of a single cartridge installed in the printer. The invention is also applicable to supplying information to a printer controller to identify two or more cartridges installed simultaneously in the same carriage 40 as shown in FIG. 3. For example, print cartridges 42 and 44 containing ink and having printheads may be installed in two locations of a multi-station carriage 40, while a scanner cartridge 46 containing an image-scanning device may be installed at another location in the same carriage 40. Alternatively, a print cartridge and a scanner cartridge could be attached to independent carriages attached to the rails 6 and belt 8 within the same printer. Regardless of whether one or more carriages are used, the carriage(s) cause the cartridges and indicia devices 48, 50 and 52 on each cartridge to move past the code reader 54. Each indicia device 48, 50 or 52 contains characters which identify the beginning and ending of each encoded sequence. The carriage may also contain an encoded indicia device identifying the number of cartridge stations present on the carriage so that the controller can determine how many indicia devices to read.

With reference to FIG. 3, in a three cartridge embodiment, for example, a carriage 40 contains a first cartridge 42, a second cartridge 44 and a third cartridge 46. Each cartridge preferably contains a different color of ink. Each ink cartridge may contain its own printhead or be attached to a printhead body which channels ink from each cartridge to selected locations on the printhead for each color. Exemplary ink colors for the cartridges are cyan, magenta and yellow. Optionally, a fourth ink cartridge (not shown) for black ink may also be employed.

In the case of multiple carriages, or multiple cartridge positions on a single carriage, the code reader 54 is preferably substantially centrally located with respect to the carriage travel distance along the support rails 6 so that all encoded information on the cartridges and/or carriages can pass adjacent to the code reader 54. As in the previous embodiment, replacing a cartridge or powering up the printer causes the carriage(s) to move a sufficient distance in the direction indicated by arrow 5 so that the indicia device (s) passes proximate to the code reader 54 so that the code reader can read the encoded information.

The electrical output signal to the printer controller may be used in conjunction with a printer control algorithm to change the operating temperature or firing parameters of the heaters on the printhead in response to the type or color of ink contained in the cartridge. In the case of multiple cartridges containing different color inks, the printer algorithm may also indicate the location of an ink cartridge of one color with respect to adjacent cartridges of different color. If an ink cartridge of a particular color is installed in an improper location in the carriage, an algorithm in the printer controller may be used to lockout the printer and notify the user of the incorrect cartridge location or otherwise adjust the printhead operation to correspond to the operating parameters required by a particular ink color.

It is contemplated, and will be apparent to those skilled in the art from the preceding description and the accompanying drawings that modifications and additions may be made to the invention. Accordingly, it is expressly intended that the foregoing description and the accompanying drawings are illustrative of preferred embodiments only, not limiting thereto, and that the spirit and scope of the invention be determined by reference to the appended claims.

What is claimed is:

1. An apparatus for supplying electrical information to a printer controller of a printer based on an identity of a replaceable accessory cartridge installed in the printer, the apparatus comprising:

a carriage which is laterally translatable relative to a movement of print media through the printer;

carriage translation means;

a replaceable accessory cartridge removably attached to the carriage, the accessory cartridge selected from the group consisting of an ink cartridge and a scanner cartridge;

at least one indicia device on the cartridge, the indicia device containing encoded information which identifies to the controller the accessory cartridge installed in the printer, the indicia device comprising optically-reflective images and optically-nonreflective images for reflecting or absorbing a first light signal, the reflected portions of the first light signal constituting a second light signal; and a light signal reading device for reading the information encoded on the indicia device as the cartridge moves in a lateral direction relative to the reading device, the reading device comprising:

a light-emitting diode for emitting the first light signal having a wavelength of about 700 nanometers toward the indicia device to illuminate the indicia device, at least one lens for receiving the first light signal from the light-emitting diode, for focusing the first light signal onto the indicia device as the indicia device translates laterally in relation to the light signal reading device, and for receiving the second light signal reflected from the indicia device, and a photodiode for receiving from the at least one lens the second light signal reflected from the indicia device, for producing an electrical output signal based on the second light signal, and for providing the electrical output signal to the printer controller.

2. The apparatus of claim 1 wherein the indicia device comprises a planar label having optically reflective and non-reflective images on one surface thereof and an adhesive material on an opposing surface thereof for fixed attaching the label to the accessory cartridge.

3. The apparatus of claim 1 further comprising two, three, or four accessory cartridges removably attached to the carriage each cartridge containing an indicia device attached thereto.

4. The apparatus of claim 3 wherein the accessory cartridges comprise a yellow ink cartridge, a cyan ink cartridge and a magenta ink cartridge.

5. An apparatus for controlling printer operation based on an identity of replaceable ink cartridges which comprises:

a carriage which is laterally translatable relative to movement of print media through the printer and which contains two, three or four cartridge locations;

carriage translation means;

two, three or four replaceable ink cartridges containing ink reservoirs that are removably attached to the carriage;

at least one indicia device on each of the cartridges, the indicia device containing encoded information which identifies which ink cartridge is installed in which cartridge location of the carriage, the indicia device comprising optically-reflective images and optically-nonreflective images for reflecting or absorbing a first light signal, the reflected portions of the first light signal constituting a second light signal;

a light signal reading device for reading the information encoded on the indicia device as the cartridges move in a lateral direction relative to the reading device, the reading device producing an electrical output signal in response to reflected and/or absorbed light signals wherein the reading device comprises a light-emitting diode for emitting the first light signal having a wavelength of about 700 nanometers toward the indicia device to illuminate the indicia device, at least one lens for focusing the first light signal onto the indicia device as the indicia device translates laterally in relation to the light signal reading device and a photodiode for receiving the second light signal reflected from the indicia device, and for producing the electrical output signal; and a printer controller for receiving the electrical output signal from the reading device, for determining based on the electrical output signal whether the ink cartridges are in appropriate cartridge locations for proper functioning of the printer, and for stopping printing operations if the ink cartridges are not in the appropriate cartridge locations.

6. The apparatus of claim 5 wherein the indicia device comprises a planar label having optically reflective and non-reflective images on one surface thereof and an adhesive material on an opposing surface thereof for fixed attaching the label to the accessory cartridge.

7. The apparatus of claim 5 wherein the ink cartridges comprise a yellow ink cartridge, a cyan ink cartridge and a magenta ink cartridge.

8. The apparatus of claim 5 further comprising a printer control algorithm responsive to the electrical output signal from the reading device for locking out printer operation for one or more incorrect ink cartridge locations.

9. The apparatus of claim 5 further comprising a printer control algorithm responsive to the electrical output signal from the reading device for changing an operating temperature of the printheads for the installed cartridges.

10. The apparatus of claim 5 further comprising a printer control algorithm responsive to the electrical output signal from the reading device for changing firing parameters for heaters on the printheads for the installed cartridges.

11. An apparatus for controlling a printer based on an identity of a replaceable accessory cartridge installed in the printer, the apparatus comprising:

a carriage which is laterally translatable relative to a movement of print media through the printer;

carriage translation means;

a replaceable accessory cartridge removably attached to the carriage, the accessory cartridge selected from the group consisting of a print head cartridge and a scanner cartridge;

at least one indicia device on the accessory cartridge, the indicia device containing encoded information that identifies the accessory cartridge installed in the printer, the indicia device comprising optically-reflective images and optically-nonreflective images for reflecting or absorbing a first light signal, the reflected portions of the first light signal constituting a second light signal; and a light signal reading device for reading the encoded information on the indicia device as the accessory cartridge moves in a lateral direction relative to the reading device, the reading device producing an electrical output signal in response to reflected and/or absorbed light signals, the reading device comprising a light-emitting diode for emitting the first light signal toward the indicia device to illuminate the indicia device, at least one lens for focusing the first light signal onto the indicia device as the indicia device translates laterally in relation to the light signal reading device, and an optical detector for receiving the second light signal reflected from the indicia device, and for producing the electrical output signal based thereon; and a printer controller for receiving the electrical output signal from the reading device, for determining based on the electrical output signal whether a print head cartridge or a scanner cartridge is installed, and for controlling the printer operation accordingly.

* * * * *